United States Patent [19]

Michelé

[11] Patent Number: 4,973,034

[45] Date of Patent: Nov. 27, 1990

[54] MASSAGE TABLE

[76] Inventor: Kodua Michelé, 3061 Lake Hollywood Dr., Los Angeles, Calif. 90068

[21] Appl. No.: 289,204

[22] Filed: Dec. 23, 1988

[51] Int. Cl.[5] ..... A47G 9/00

[52] U.S. Cl. ..... 269/324; 5/462; 5/464

[58] Field of Search ..... 269/322–328; 5/462, 464, 463, 465, 455; 128/69–74

[56] References Cited

U.S. PATENT DOCUMENTS

| | | | |
|---|---|---|---|
| 2,089,854 | 8/1937 | Pellegrini | 5/462 |
| 2,606,801 | 8/1952 | Shampaine | 269/324 |
| 3,378,862 | 4/1968 | Skinner | 5/462 |
| 3,464,069 | 9/1969 | Bien | 5/462 |
| 4,021,872 | 5/1977 | Powell | 5/462 |
| 4,596,384 | 6/1986 | Blosser | 269/325 |
| 4,737,999 | 4/1988 | Halverson | 5/464 |

*Primary Examiner*—Robert C. Watson

*Attorney, Agent, or Firm*—Blakely, Sokoloff Taylor, Zafman

[57] ABSTRACT

The present invention is an improved massage table having a cutout disposed therein with a removable insert that exposes a cavity in the area of a pregnant woman's stomach and abdomen to accommodate the enlarged area comfortably thereby allowing the pregnant woman to receive massage therapy in a prone position. The cavity has disposed therewithin a recessed material covering which provides support without undue pressure to the woman's abdominal area. Lateral supports and a sternum support are also provided for additional comfort and security.

19 Claims, 6 Drawing Sheets

Fig. 7
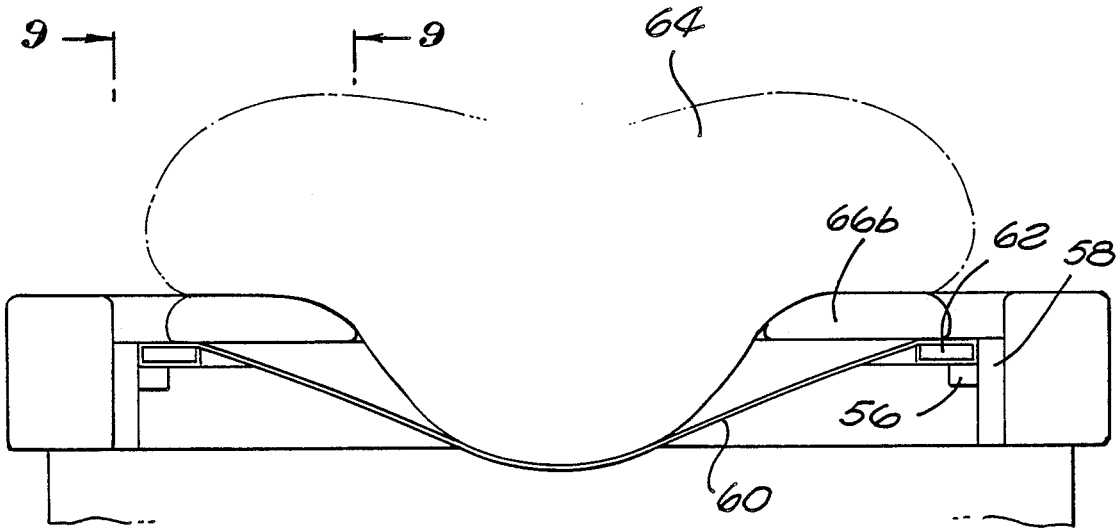
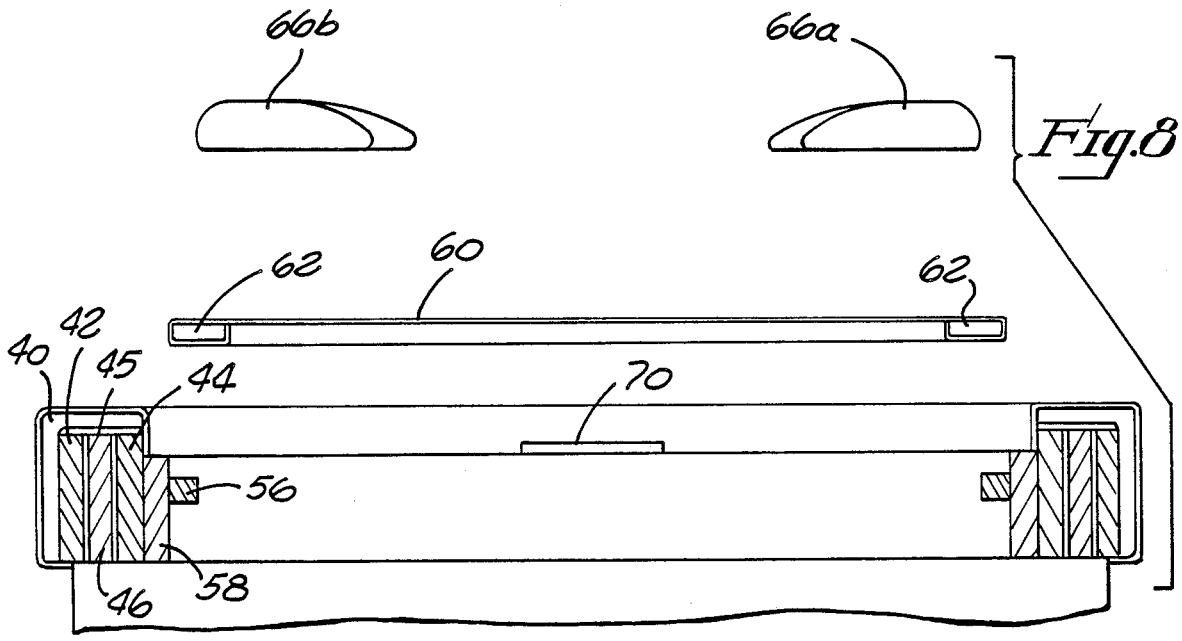
Fig. 8
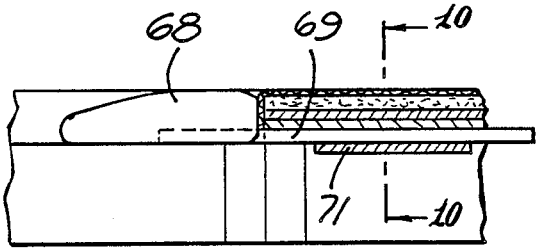
Fig. 9
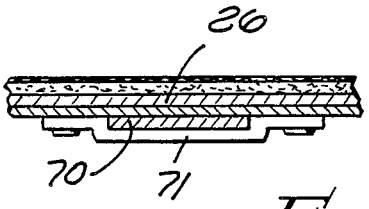
Fig. 10

MASSAGE TABLE

BACKGROUND OF THE INVENTION

1. Field of the Invention:

This invention relates to the field of massage tables, and more particularly, to a stationary or portable massage table or convertible medical examination table adaptable for use with pregnant women.

2. Art Background:

In the area of massage, medical treatment and in particular, treatment for pain and discomfort during pregnancy, such as through massage therapy, there is a distinct lack of available devices designed for pregnant women. Many pregnant women complain of ongoing back and leg pains, swollen hands and feet and constant tiredness during their pregnancies. Doctors have commonly recognized that if the pregnant woman were to receive massages, particularly on a regular basis, many of the foregoing complaints would be alleviated, or at least greatly minimized.

The major drawback of existing massage tables is that, while they are generally acceptable for use in connection with normal ailments on typical non-pregnant patients, the design of such massage tables is unacceptable for pregnant patients having distended abdominal areas. There are no prior art massage tables or prenatal care tables which allow the pregnant woman to comfortably lie in a prone position. As such, a pregnant woman desiring a massage must either receive it while laying on her side, which has generally been shown to be less effective than laying in a prone position, or alternatively, she must endure a massage in a very uncomfortable prone position.

Some attempts have been made to address the problem of providing a comfortable sleeping area for pregnant women. However, the devices in the prior art have several drawbacks, and further, there is no device specifically designed for massage which accommodates the physiology of pregnant women.

A number of prior art devices have been developed which are relevant to the subject invention.

U.S. Pat. No. 2,726,407 discloses a medical cart and supporting structure which includes a portion which raises to elevate the head of a patient and which further includes cabinets and drawers for storing items below the cart.

U.S. Pat. Nos. 3,464,069; 4,021,872; 3,988,793; 4,051,566; 4,054,960; and 4,382,306 all disclose mattresses or cots of various types having recessed areas or cavities therein adapted to fit the abdominal and stomach area of a pregnant woman, thereby providing comfort and relieving pressure to the abdomen when it is distended as a result of pregnancy. However, one problem associated with many of the above-referenced inventions is that they do not provide structure for gradually changing the size of the cavity in the mattress as the abdomen of the pregnant woman expands during the course of pregnancy. In fact, many of the above-referenced devices provide only a cavity of fixed size and do not provide any support whatsoever for the woman's abdomen. Such structures thereby allow the woman's abdominal walls to stretch and sag as a result of gravity rather than providing any minimal support thereto which would provide comfort to the pregnant woman. Other of the above-referenced devices which do provide some support to the abdominal region provide only a fixed space in which the pregnant woman's abdomen may fit, so that if the woman's abdomen is either too large or too small to exactly accommodate the area provided therefor, the woman may experience some or even severe discomfort.

In particular, in connection with massage tables, there is no prior art device which is specifically designed for massage therapy and which allows a woman to receive a massage which is so vital for her daily comfort, particularly during the latter months of pregnancy. These and other problems are overcome with the present invention, which is described briefly below.

SUMMARY OF THE INVENTION

The present invention is an improved massage table, and essentially, a massage table adapted to be used for massaging pregnant women, although it may also be used for massaging non-pregnant patients, both men and women. The table is also specifically effective for obese men and women with large stomach and abdominal areas. The present invention is designed to provide pregnant women with the opportunity to enjoy a massage while lying on their stomaches.

The invented massage table comprises a platform on which the patient lies, the platform being divided into a head portion and a foot portion. The head portion of the platform may be raised to an inclined position whereby the patient's head and shoulders may be elevated above the heart and legs. The entire device is made of nonporous wood covered with plastic material, such as vinyl, which is approved and effective for use in hospitals and other medical settings.

Provided in the head portion of the platform is a removable insert. When the patient is lying on her back, the insert is installed so that a solid support is provided for the back of the patient. In the alternative mode, the solid support is removed and a square or rectangular cavity is provided to accommodate the stomach and abdominal area of the pregnant woman, obese person or other similarly situated patient. Provided in the cavity is a stretchable fabric material which provides the requisite amount of support for the stomach and abdominal area of the patient with minimal pressure thereto. Also provided in the cavity area in this alternative mode of operation is a pair of sliding longitudinal support members which are slideable to a position abutting the distended stomach and abdomen of the pregnant woman to provide support and comfort thereto. The longitudinal support members are generally rectangular and slightly wider at the ends than in the middle, and are specifically designed to comfortably support most pregnant woman. Also provided is a sternum support means which preferably is attached to the support table by means of a tongue-in-groove support device. The sternum support means is designed to fit along the sternum of most pregnant women without interfering with their breasts, which tend to be tender during pregnancy.

The invented massage table is also provided with a plurality of drawers and storage areas thereunder for storing various massage lotions or any other medical and/or massage supplies which are required.

Additionally, the invented massage table is designed in one embodiment to appear and function like a standard medical examination table so that it can be used for alternative purposes. In another embodiment, the invented massage table is only designed for use as a massage table. In yet another embodiment, the invented massage table is lightweight and designed to be portable.

The use of the invented massage table enables pregnant women to be massaged in their neck, back and lower body while laying on their stomach without applying any substantial pressure to the abdomen and stomach region. By the use of the present invention, it is anticipated that the circulatory problems and lower back stress which typically accompany pregnancy may be alleviated or at least diminished.

It is an object of the present invention to provide a massage table useful and comfortable for massaging pregnant women.

It is yet another object of the present invention to provide a massage table which is capable of being used for typical massage patients as well as pregnant and obese patients.

It is yet another object of the present invention to provide a general medical table for use in connection with a variety of medical procedures and examinations, which examination table is convertible for use as a massage table for pregnant women.

It is yet another object of the present invention to provide a massage table having a head portion which may be inclined at a variety of different elevations.

It is yet another object of the present invention to provide a massage table having sufficient storage thereunder for storing massage oils and creams as well as other medical and massage supplies.

This and other objects of the present invention will be understood with reference to the drawings briefly described below.

BRIEF DESCRIPTION OF THE DRAWINGS

FIG. 7 is a cross-sectional view of the present invention taken through lines 7—7 of FIG. 6.

FIG. 8 is an exploded view of the present invention as shown in FIG. 7, without the pregnant woman disposed thereon.

FIG. 9 is a cross-sectional view of the sternum support of the present invention taken through lines 9—9 of FIG. 7.

FIG. 10 is a cross-sectional view of the attachment means of the sternum support taken through lines 10—10 of FIG. 9.

DETAILED DESCRIPTION OF THE INVENTION

The present invention comprises a massage table which is particularly designed for use with pregnant women. Of course, it will be recognized by persons of ordinary skill in the art that it can be used for non-pregnant persons as well as obese persons and it is useful for any of the foregoiing applications. Obviously such other uses of the subject table are contemplated by the present invention and are covered hereunder.

Figure 1:
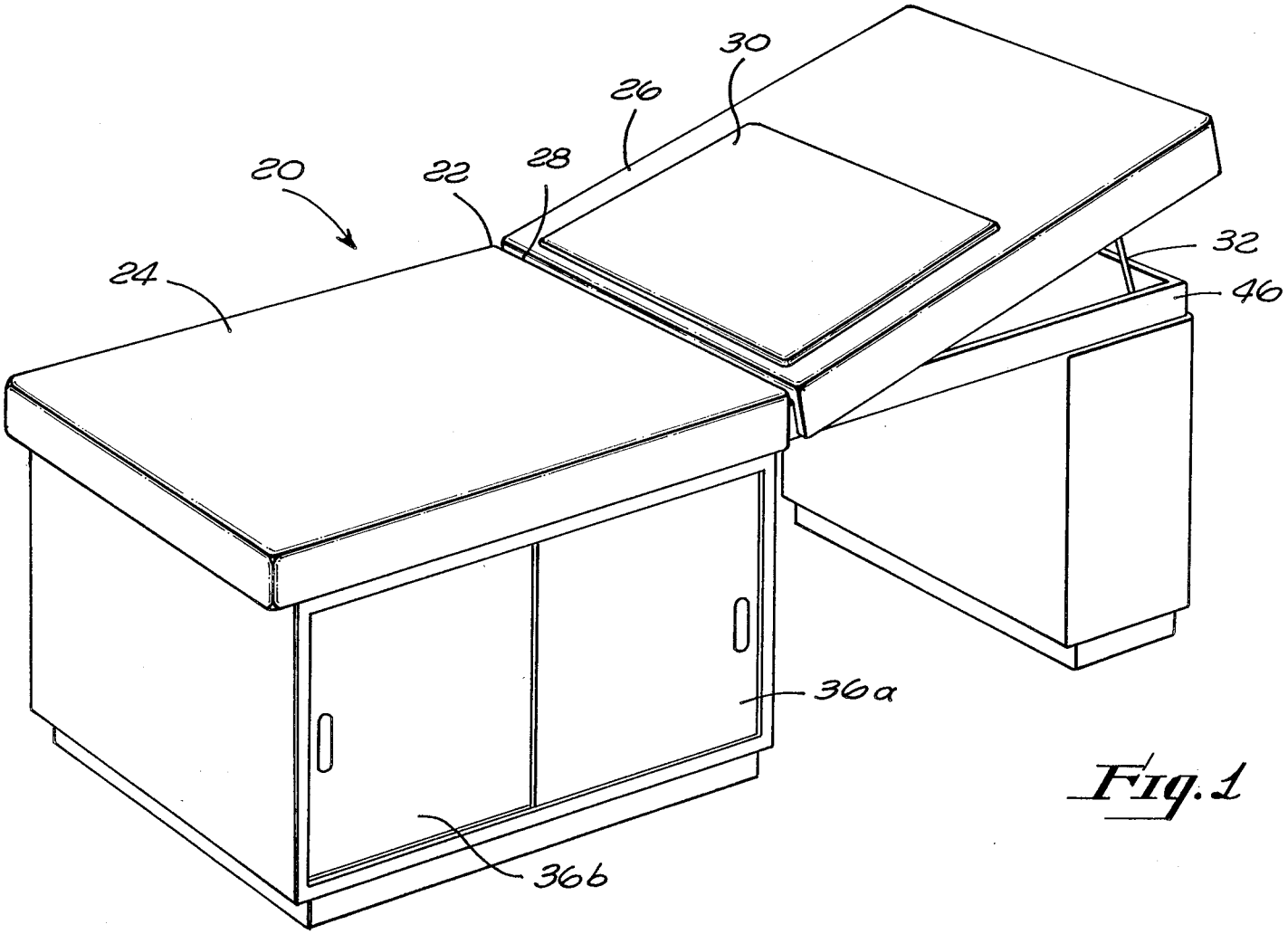
FIG. 1 is a perspective front view of the present invention with the head portion of the platform in a raised position.
Figure 2:
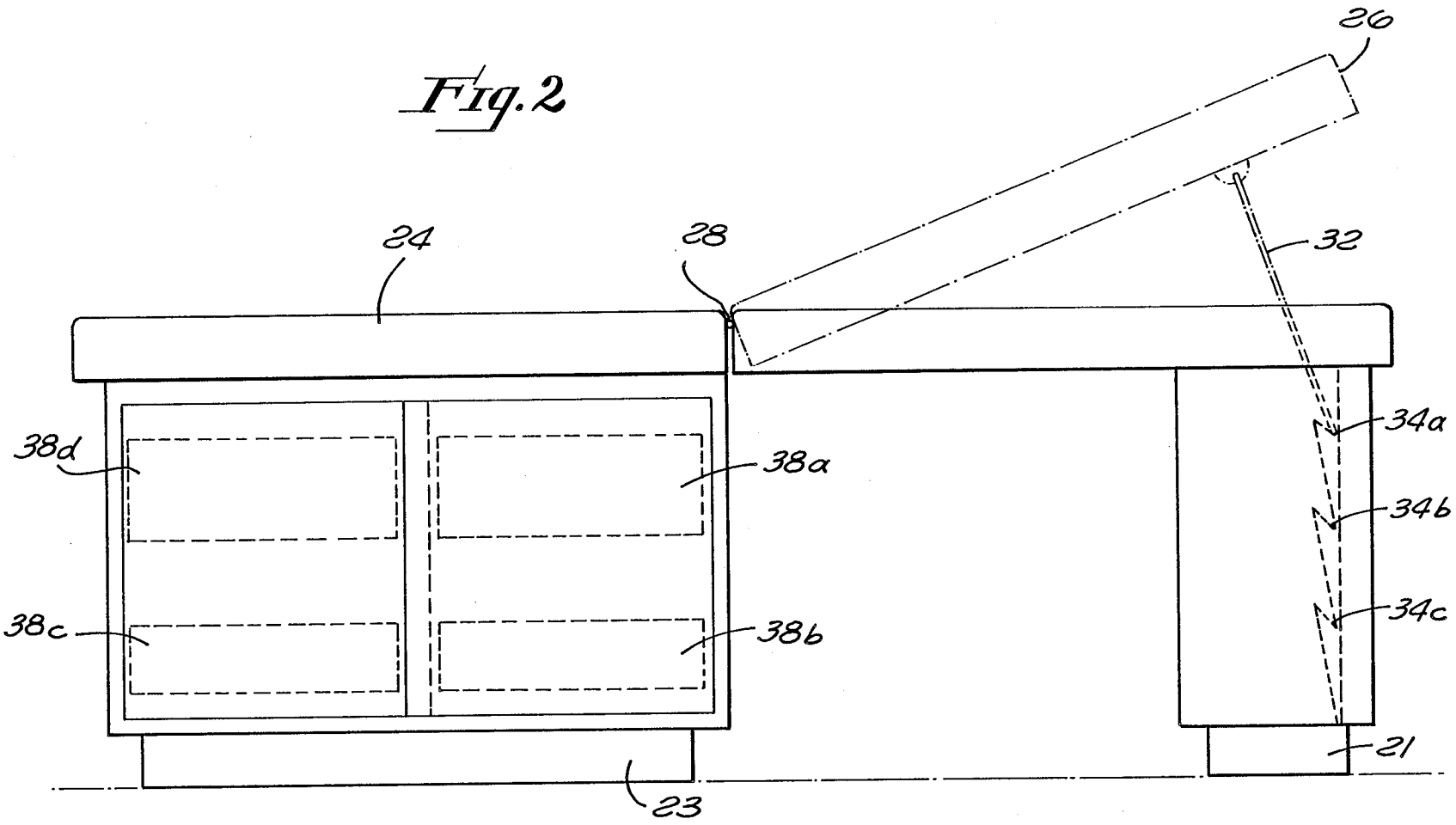
FIG. 2 is a front view of the present invention with the head portion of the platform in a raised position and the interior thereof provided in ghostlines.
Figure 3:
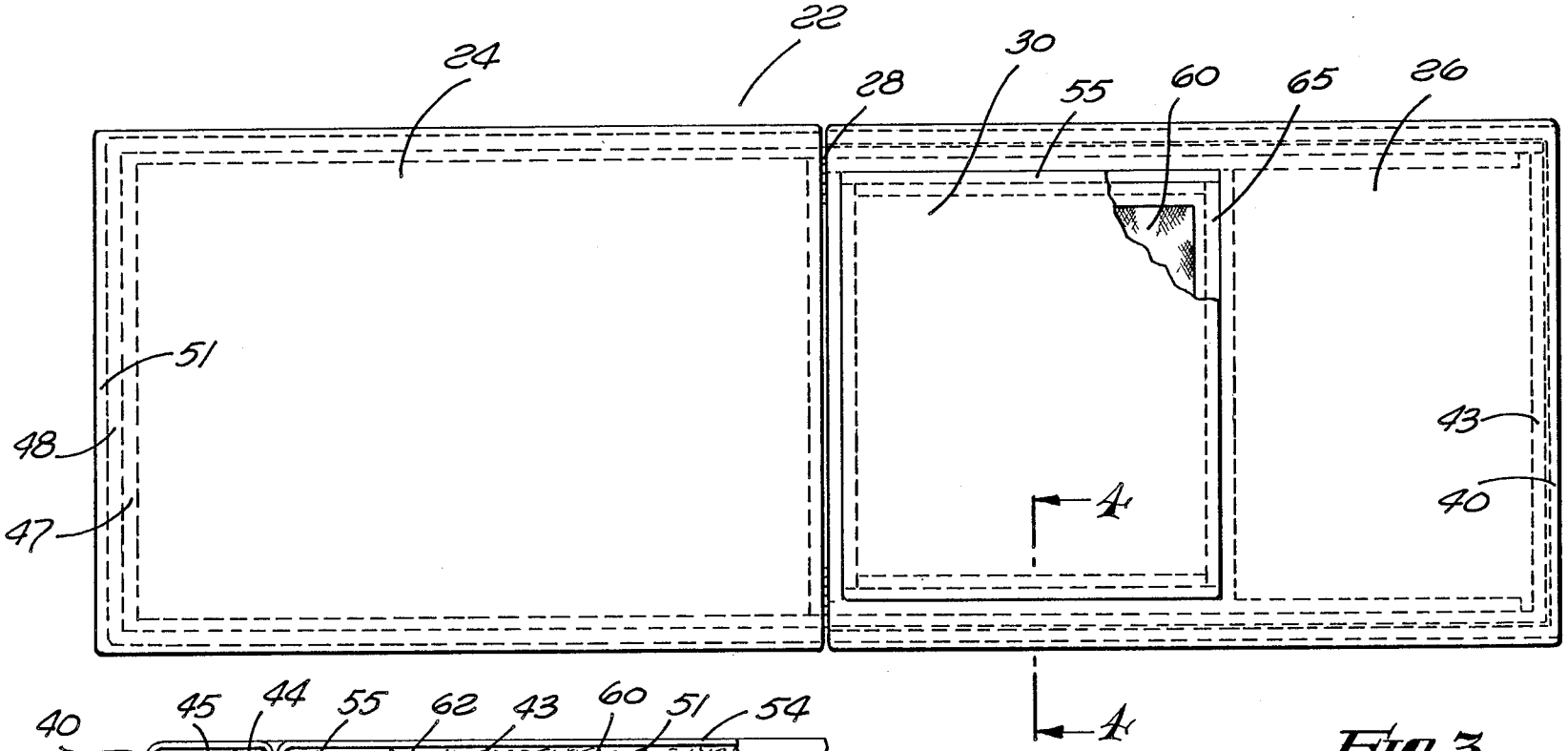
FIG. 3 is a top plan view of the present invention with the removable solid support member shown in a partially cutaway view.

The present invention, namely an improved massage table, delineated herein by the numeral 20 comprises generally a platform 22 having a foot section 24 and a head section 26. The platform 22 is supported on base members 21 and 23. The foot section 24 is disposed on a solid frame and the head section 26 is hinged at 28 so that it may be raised to an upward inclined position as shown in FIGS. 1 and 2, for example. The head section 26 has a removable insert 30 which, when installed in position, provides a solid support such as for normal patients or for use in connection with pregnant patients lying on their backs. The head platform 26 is supported in the upward position preferably by support member 32 being pivotally attached to platform 26 at one end thereof and being disposed at the other end thereof in detentes 34(*a*), (*b*), or (*c*).

The device generally also has in the preferred embodiment a pair of sliding doors 36(*a*) and (*b*) which cover an area with shelves or drawers 38 (*a*), (*b*), (*c*) and (*d*).

Figure 4:
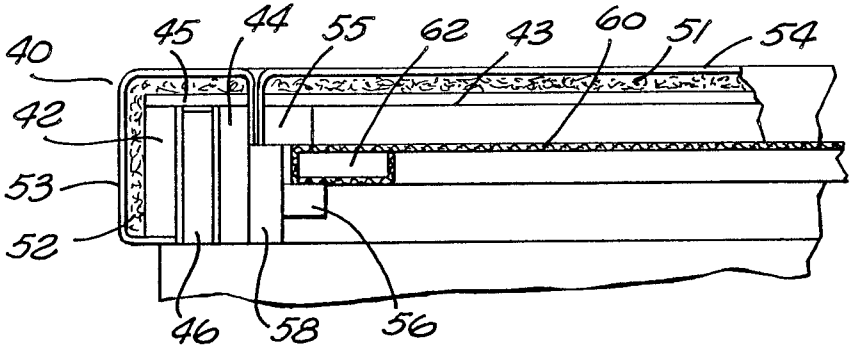
FIG. 4 is a partial cross-sectional view of the upper platform and removable solid support of the present invention as indicated in Lines 4—4, shown in FIG. 3.

As shown in FIG. 4, the head platform 26 comprises a border 40 comprising members 42 and 44 attached together by cross-member 43 which sandwiched therebetween frame member 46. Similarly, with respect to the foot platform 24, the platform comprises an upright border 47 and a padded platform member 48 with downward edges 49 circumventing the border 47. The entire platform 22 comprises in general a wooden or other solid base member, such as 43 or 45, for example, covered by a foam or other resilient material pad, such as 51 and 52, which in turn is covered by plastic, such as vinyl, or other water proof or resistant material 53 and 54. In this manner, a secure solid platform is provided.

The removable insert 30 comprises a frame member 55 with a solid base member 43 attached thereto and covered by a foam or resilient member 51. The removable insert 30 is supported by inset support member 58 which is disposed under the periphery of the removable insert 30. Attached to insert support member 58 is material support member 56 which supports the frame 62 which holds the resilient material 60 in position. Resilient material 60 provides the support for the pregnant woman's abdomen when the woman is lying in the prone position on the platform 22.

Figure 5:
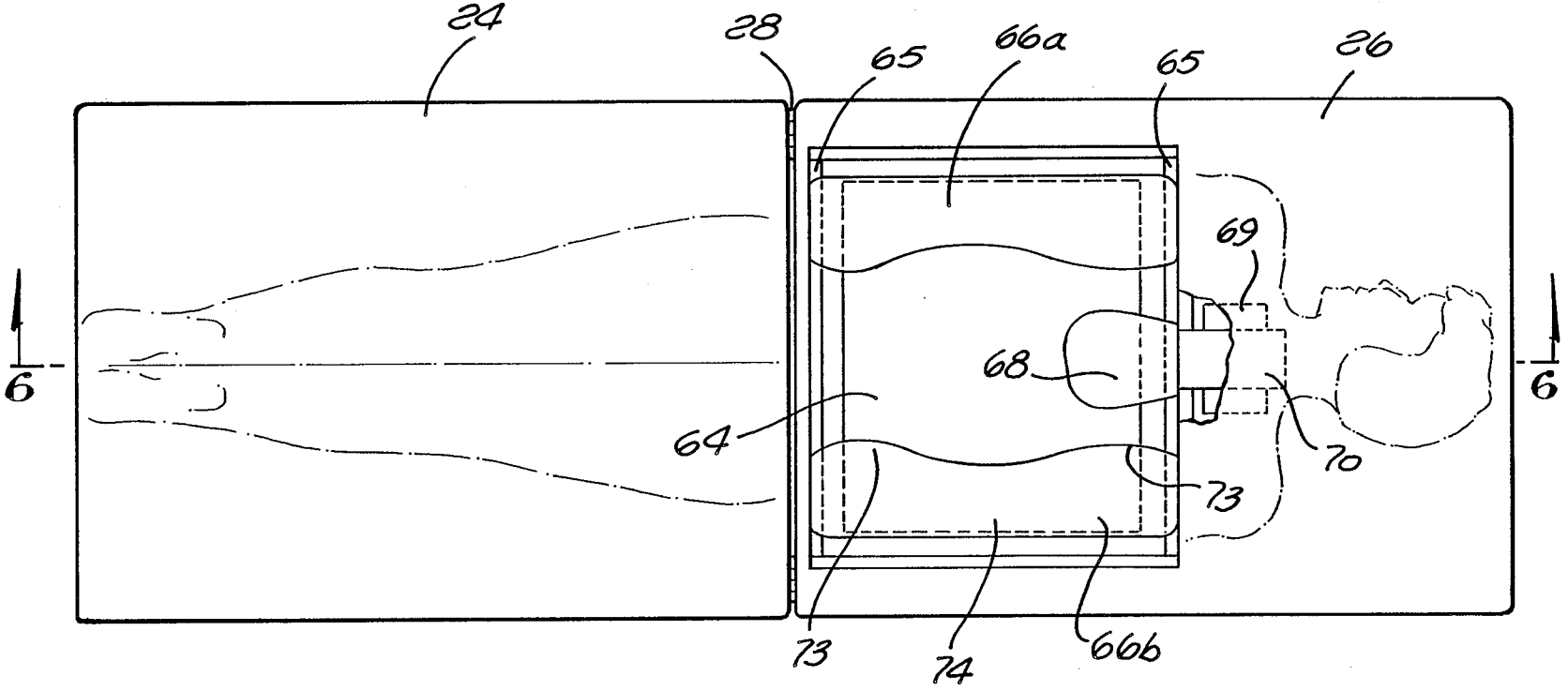
FIG. 5 is a top plan view of the present invention with a pregnant woman lying thereon in a prone position shown in dotted lines.
Figure 6:
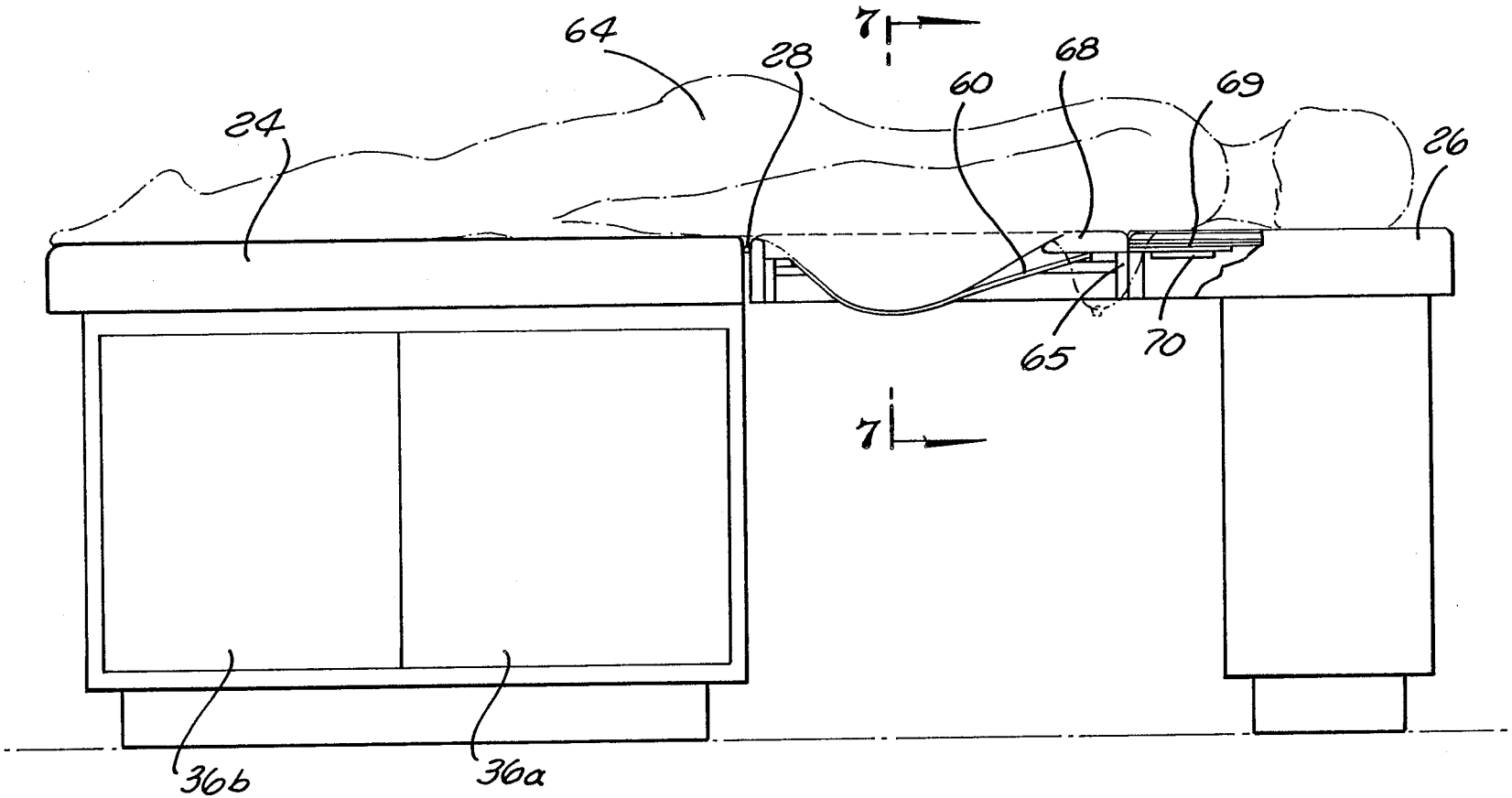
FIG. 6 is a partially cutaway front view of the present invention with a pregnant woman thereon as shown in FIG. 5.

As shown in FIGS. 5 and 6, a pregnant woman patient 64 is shown lying on the invented massage table 20. The woman 64 is shown in dotted lines. FIG. 5 shows the support structure for the patient in the cavity, which support structure comprises a pair of side supports 66*a* and 66*b* and a sternum support 68. The side supports 66*a* and 66*b* have a contoured generally rectangular shape. They are rounded at all corners and are slightly wider at the ends 73 than in the middle 74. This shape has been tested on woman of all sizes and shapes and has been found to be the optimum shape to accommodate most pregnant women. The side supports are padded for comfort. The sternum support 68 is generally a rounded rectangular shape and is designed and adapted to fit between the breasts of most pregnant women. This is particularly important because the breasts of the pregnant women tend to be very sensitive during pregnancy and undue pressure thereon may provide severe discomfort. Optimally, the sternum support extends along the sternum down to near the end of the sternum in between the breasts of the pregnant woman lying on the massage table in a prone position.

The resilient material 60 is shown supporting the woman's abdominal region in FIG. 6 and the sternum support 68 is shown supporting the sternum of the patient 64. The side supports 66*a* and 66*b* are supported on a small side support platform 65 disposed on opposite sides of the cavity so that they can slide in the cavity to a desired position underneath the patient 64 such that the patient is minimally supported without applying any substantial pressure to the abdominal area of the patient. The sternum support 68 comprises a tongue member 69 which is adapted to removably fit within groove 70, formed by bracket 71 attached to the underside of the platform to secure it in place as shown in FIGS. 9 and 10.

The adaptation and use of the lateral support members 66*a* and 66*b* are important for the support and comfort of the patient. The prior art devices, with one exception do not provide any support or allow for any variation in the size of the protruding abdomen as a function of the size and shape of the pregnant women particularly in light of the gestational age of the fetus. Instead, the prior art devices merely provide a cavity or recess in a mattress or the like of uniform size with the presumption and expectation that such cavity or recess is acceptable for all woman. This presumption has been shown to be incorect, and the present invention takes into account the variation in the size of the women by providing both lateral supports which can slide within the recessed cavity to a position abutting the patient and the sternum support.

Thus, the present invention provides security and comfort to the patient to a much greater extent that the prior art devices. Also, by providing a stretchable material 60 the woman's abdominal and stomach regions are supported to a sufficient extent that there is no substantial pressure or discomfort to the patient, although there is a reasonable amount of support provided to eliminate any undue stress on the abdominal muscles and tissue. The material can be any stretchable, resilient fabric, either natural or synthetic. In the preferred embodiment, the material is a double knit or two layers of single knit polyester or nylon. However, it will be appreciated by a person of ordinary skill in the art that there are numerous materials and combinations of materials which will function in accordance with the spirit and scope of the present invention.

As is shown in FIG. 7, the lateral support member 66*a* and 66*b* are disposed in position abutting the stomach and abdomen of the pregnant woman. The material 60 is stretched to accommodate the protrusion caused by the stomach and abdomen. The material is disposed in a frame 62 which is rectangular or square and the material is stapled, glued or otherwise adhered thereto.

FIG. 8 shows an exploded view of the cavity or recess of the present invention including the lateral support members 66*a* and 66*b*, the frame 62 with the material 60 attached thereto, border 40 comprising members 42 and 44 attached together by cross-member 43 which sandwiched therebetween frame member 46, covered by a foam or other resilient material pad 52, which in turn is covered by plastic or other water proof or resistant material 53.

It will be obvious to a person of ordinary skill in the art that a number of modifications and changes can be made to the subject invention without departing from the spirit and scope of the present invention, which is defined by the claims appended hereto and all equivalents thereof.

I claim:

1. A massage table of the type comprising a flat platform supported on a frame, wherein the improvement comprises:

a removable insert member disposed on said platform above a cavity in a position which in use is adjacent to the stomach and abdominal region of a pregnant woman lying thereon, said removable insert member comprising a solid surface capable of partially supporting the body of a patient, and when said removable insert member is removed, said cavity is uncovered; and a flexible, resilient material disposed under said removable insert member and recessed below said platform, said material covering said cavity; and a pair of lateral support members insertable in said cavity and aligned longitudinally therein and adjacnet the sides of a pregnant woman disposed on said table, said lateral support members being slideable in said cavity to accommodate and support pregnant women of varying sizes.

2. The massage table of claim 1 further comprising a sternum support member removably disposed in said cavity in a position adjacent the upper portion of a pregnant woman's chest when lying on said table.

3. The massage table of claim 2 wherein said sternum support member comprises a padded substantially flat member with a narrow flat tongue member attached thereto and a slot means coupled to said table below the platform and adjacent said cavity, wherein said tongue member may be inserted in said slot means to secure said sternum support member in position in said cavity.

4. The massage table of claim 1 further comprising a plurality of drawers disposed in said frame.

5. The massage table of claim 1 wherein said platform is covered with a padding material and said padding material is covered with a non-absorbable plastic material.

6. The massage table of claim 1 wherein said flexible, resilient material is selected from natural and synthetic materials and combinations thereof.

7. The massage table of claim 6 wherein said flexible, resilient material is selected from double knitted polyester and nylon.

8. The massage table of claim 1 wherein said massage table is a convertible medical examination table.

9. The massage table of claim 1 wherein said massage table is portable.

10. The massage table of claim 1 wherein lateral support members are contoured to fit slightly around the enlarged abdominal region of a pregnant woman.

11. The massage table of claim 3 wherein said sternum support member is sufficiently narrow to fit between the breast of a pregnant woman without providing any substantial pressure thereto.

12. A massage table of the type comprising a flat platform supported on a frame, wherein the improvement comrises:

a removable insert member disposed on said platform above a cavity in a position which in use is adjacent to the stomach and abdominal region of a pregnant woman lying thereon, said removable insert member comprising a solid surface capable of partially supporting the body of a patient, and when said removable insert member is removed, said cavity is uncovered; and a flexible, resilient material comprised of polyester fabric disposed under said removable insert member and recessed below said platform, said material covering said cavity; and a pair of lateral support members insertable in said cavity above said material and aligned longitudinally therein and adjacent the sides of a pregnant woman disposed on said table, said lateral support members being slideable in said cavity to accommodate and support pregnant women of varying sizes.

13. The massage table of claim 12 further comprising a sternum support member removably disposed in said cavity in a position adjacent the upper portion of a pregnant woman's chest when lying on said table, said sternum support member comprising a padded substantially flat member with a narrow flat tongue member attached thereto and a slot means coupled to said table below the platform and adjacent said cavity, wherein said tongue member may be inserted in said slot means to secure said sternum support member in position in said cavity.

14. The massage table of claim 12 further comprising a plurality of drawers disposed in said frame.

15. The massage table of claim 12 wherein said platform is covered with a padding material and said padding material is covered with vinyl.

16. The massage table of claim 12 wherein said massage table is a convertible medical examination table.

17. The massage table of claim 12 wherein said massage table is portable.

18. The massage table of claim 12 wherein lateral support members are contoured to fit slightly around the enlarged abdominal region of a pregnant woman.

19. The massage table of claim 13 wherein said sternum support member is sufficiently narrow to fit between the breast of a pregnant woman without providing any substantial pressure thereto.

* * * * *

UNITED STATES PATENT AND TRADEMARK OFFICE

CERTIFICATE OF CORRECTION

PATENT NO. : 4,973,034

DATED : 11/27/90

INVENTOR(S) : Michelé

It is certified that error appears in the above-identified patent and that said Letters Patent is hereby corrected as shown below:

| | | |
|---|---|---|
| col. 04, line 04 | delete "foregoiing" | insert --foregoing-- |
| col. 04, line 43 | delete "inset" | insert --insert -- |
| col. 05, line 30 | delete "incorect" | insert --incorrect-- |
| col. 05, line 36 | delete "that" | insert --than-- |
| col. 06, lines 21-22 | delete "adjacnet" | insert --adjacent-- |
| col. 06, line 62 | delete "comrises" | insert --comprises-- |

Signed and Sealed this

First Day of June, 1993

*Attest:*

Michael K. Kirk

MICHAEL K. KIRK

*Attesting Officer*

*Acting Commissioner of Patents and Trademarks*